US006946942B1

(12) United States Patent
Chih-Min

(10) Patent No.: US 6,946,942 B1
(45) Date of Patent: Sep. 20, 2005

(54) TRANSFORMER

(75) Inventor: Lin Chih-Min, Taoyuan (TW)

(73) Assignee: Amphenol Taiwan Corporation, Taoyuan (TW)

( * ) Notice: Subject to any disclaimer, the term of this patent is extended or adjusted under 35 U.S.C. 154(b) by 0 days.

(21) Appl. No.: 10/813,024

(22) Filed: Mar. 31, 2004

(51) Int. Cl.[7] ..... H01F 27/02
(52) U.S. Cl. ..... 336/90; 336/192; 336/105
(58) Field of Search ..... 336/90, 192, 105, 336/107

(56) References Cited

U.S. PATENT DOCUMENTS 4,686,506 A * 8/1987 Farago ..... 341/100
5,272,459 A * 12/1993 Geery ..... 336/61
5,669,785 A * 9/1997 Hammer et al. ..... 439/396
5,844,781 A * 12/1998 Schlotterer et al. ..... 361/752
6,049,051 A * 4/2000 Dosmo et al. ..... 218/155
6,497,592 B1 * 12/2002 Beadle ..... 439/814
6,773,302 B2 * 8/2004 Gutierrez et al. ..... 439/541.5

* cited by examiner

*Primary Examiner*—Anh Mai
(74) *Attorney, Agent, or Firm*—Troxell Law Office, PLLC

(57) ABSTRACT

A transformer comprises a rectangular insulative housing, a plurality of inductive coils received in the insulative housing, and a plurality of soldering tails. The insulative housing includes a bottom wall and four sidewalls, and forms a plurality of partitions therein for receiving the inductive coils. Each inductive coil has a first wire and a second wire. The soldering tails are provided at two opposing sidewalls of the insulative housing. Each soldering tail has a soldering end at exterior of the insulative housing for electrically connecting with a PCB of a communication connector, and a wiring end at interior of the insulative housing for connecting with the first wire and the second wire of the inductive coils. The transformer is modularly produced, and is tested before it is assembled to a communication connector. Thus the manufacture process is flexible and the communication connector provides stable signal transmission.

10 Claims, 3 Drawing Sheets

TRANSFORMER

BACKGROUND OF THE INVENTION

1. Field of the Invention

The present invention relates to a transformer, and particularly to a transformer used in a communication connector for stably transmitting signals.

2. Related Art

Signal transmission, especially high-speed signal transmission, is subject to current and external interference. Currently, in order to make signal transmission stable, transformers are popularly used in communication connectors for signal transmission between computers and peripherals. Such a transformer often has filtering function, as disclosed in U.S. Pat. Nos. 4,754,370, 5,015,204, 5,139,442, 5,687,233, 5,872,492, 5,833,496, 6,102,741 and 6,456,180.

The conventional transformer usually has inductive/impedance coils. Each inductive/impedance coil has two ends respectively serving for mating with a mating connector and soldering to a PCB, sometimes serving for connecting with the communication connector and soldering to a PCB. There are some deficiencies of this design in manufacture and use as followings.

(1) manufacture process is inflexible. An end of the inductive/impedance coil, which serves for mating with a mating connector or serves for connecting with the communication connector, has to be assembled on an assembling board, or has to connect with terminals of the communication connector via a series of connecting process in advance. Then it connects with a PCB before testing signal transmission of each terminal. Thus the manufacture process is constrained of series connecting/assembling first. Some conventional communication connectors provide instruction lights for displaying proper signal transmission. Similarly, the instruction lights have to be mounted on a housing and assembled to a PCB first before testing.

(2) mass production is inefficient. Manufacturing as described above, once problems are found in testing process, for example, a terminal fails to communicate with inductive/impedance coils or instruction lights can't work, the defective products have to back to the series connected/assembled mentioned before to reproduce. This makes manufacture process troublesome.

SUMMARY OF THE INVENTION

Accordingly, an object of the present invention is to provide a transformer, which is modularly produced and separately assembled on a communication connector for making manufacture process flexible and rapid.

Another object of the present invention is to provide a transformer which is easily assembled independent of soldering and which prevents from electromagnetic and noise interference for stable signal transmission.

The transformer of the present invention comprises a rectangular insulative housing, a plurality of inductive coils and a plurality of soldering tails. The insulative housing includes a bottom wall and four sidewalls, and defines an opening toward a top thereof. A plurality of partitions is formed in the insulative housing for receiving the inductive coils. Each inductive coil has a first wire and a second wire. The soldering tails are provided at two opposing sidewalls of the insulative housing. Each soldering tail has a soldering end at exterior of the insulative housing for electrically connecting with a PCB of a communication connector, and a wiring end at interior of the insulative housing for connecting with the first wire and the second wire of the inductive coils.

DESCRIPTION OF THE PREFERRED EMBODIMENTS

Figure 1:
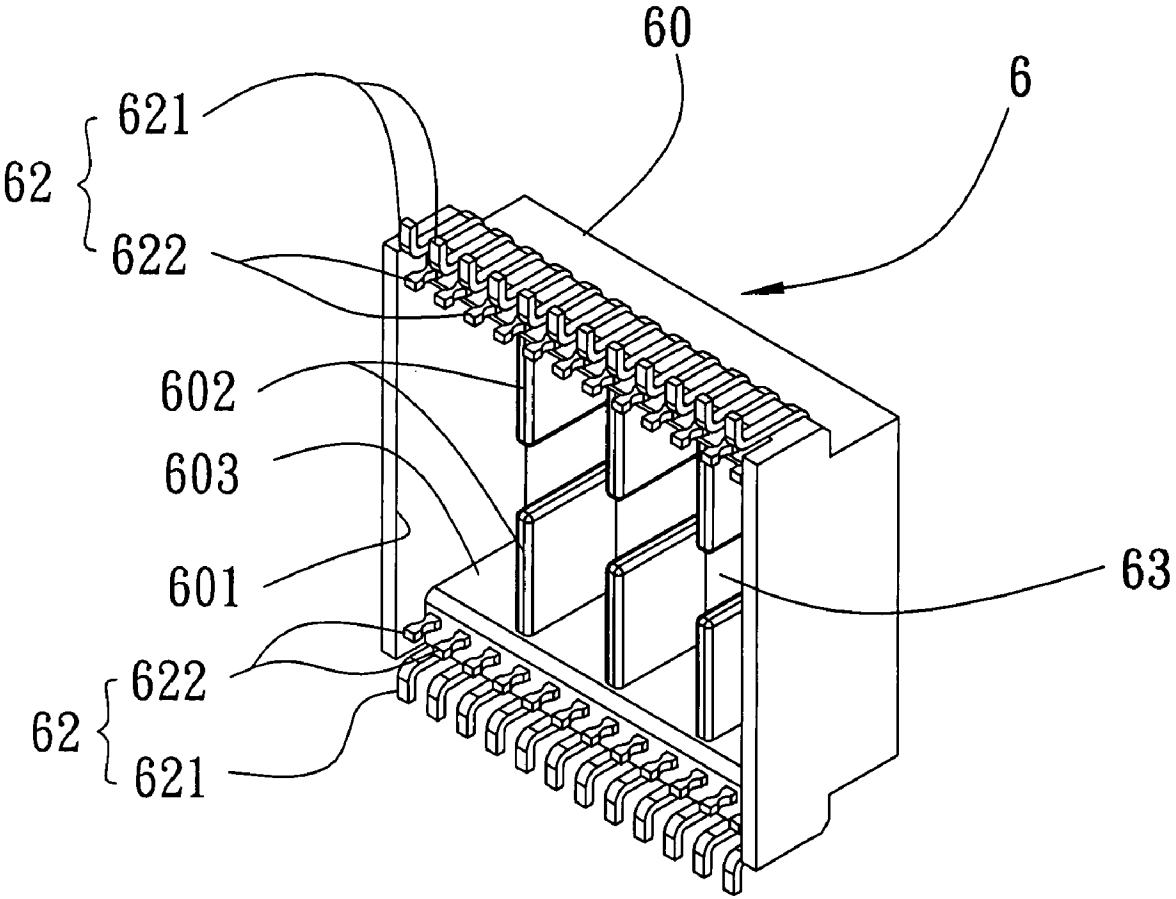
FIG. 1 is a perspective view of an insulative housing of a transformer according to the present invention.
Figure 2:
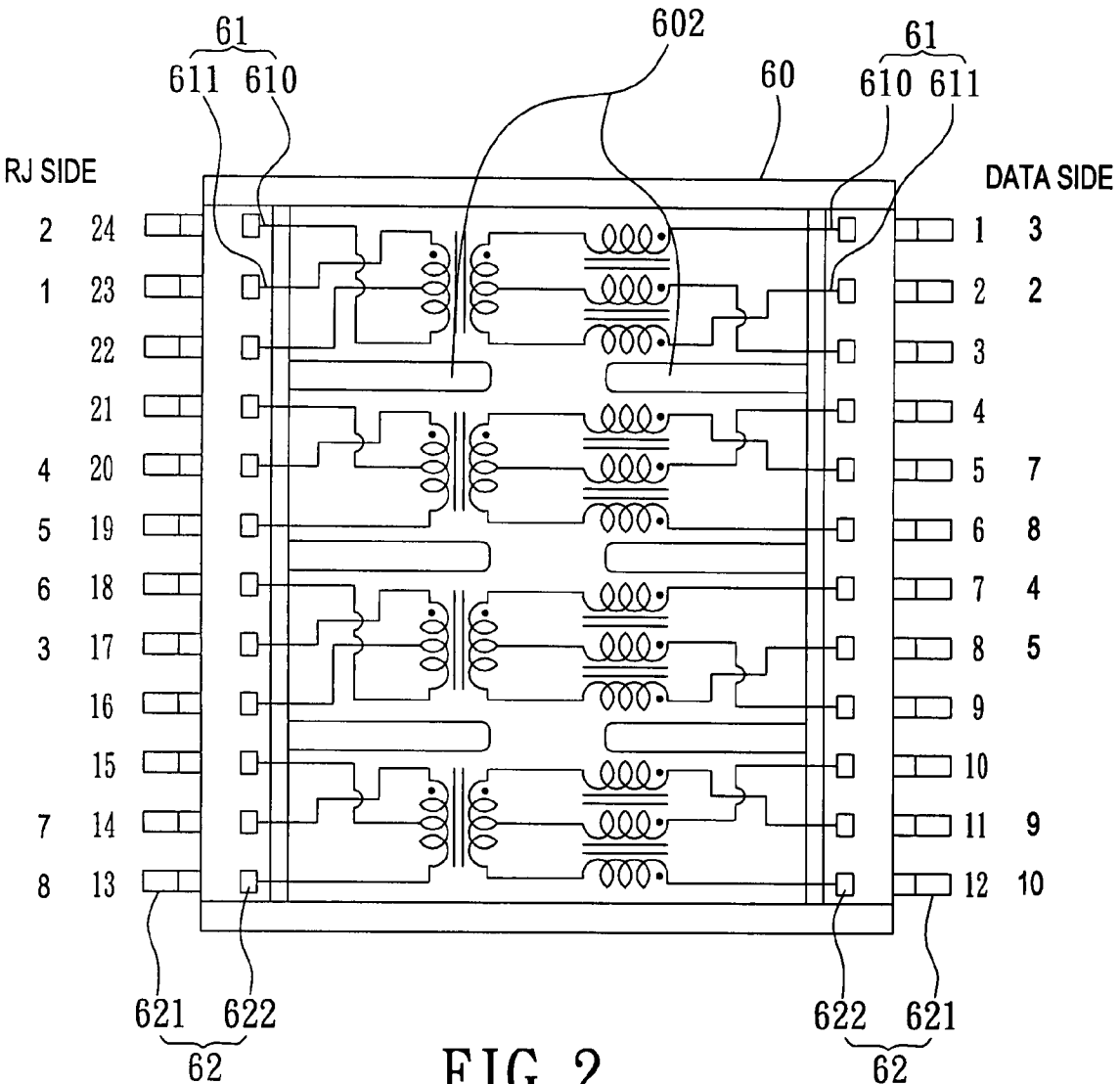
FIG. 2 is a plane view of the insulative housing of FIG. 1 with inductive coils assembled therein.

With reference to FIGS. 1 and 2, a transformer 6 in accordance with the present invention comprises a rectangular insulative housing 60, a plurality of inductive coils 61 and a plurality of soldering tails 62. The insulative housing 60 includes a bottom wall (not labeled) and four side walls (not labeled), and defines an opening 601 toward a top thereof. Two tables 603 are respectively formed at inner surfaces of two opposing sidewalls of the insulative housing 60 for positioning the soldering tails 62. A plurality of partitions 602 is formed in the insulative housing 60 and is spaced the same distance from each other for receiving the inductive coils 61. A channel 63 is defined through a middle of the partitions 602 for accommodating more inductive coils 61. Each inductive coil 61 has a first wire 610 and a second wire 611. The soldering tails 62 are mounted on two opposing sidewalls of the insulative housing 60 and extend beyond from the opening 601. Each soldering tail 62 has a soldering end 621 at exterior of the insulative housing 60 for electrically connecting with a PCB 3 (shown in FIG. 3) of a communication connector (not labeled), and a wiring end 622 at interior of the insulative housing 60 for connecting with the first wires 610 and the second wires 611. Each soldering end 621 forms an extreme end (not labeled) bending perpendicularly therefrom and extending beyond the insulative housing 60.

Figure 3:
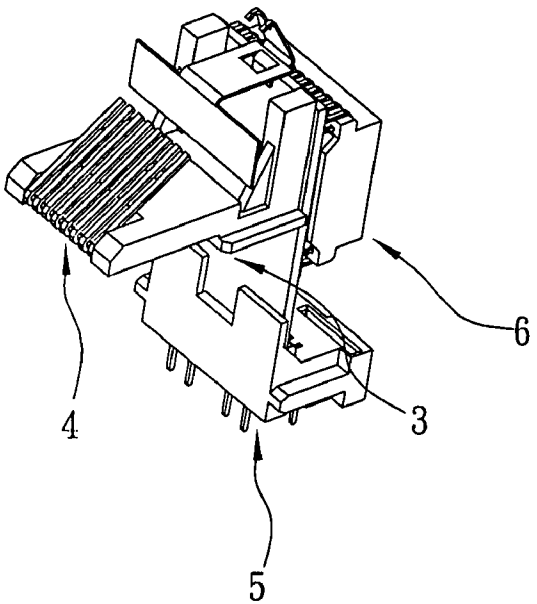
FIG. 3 is a perspective view of the transformer of FIG. 1 assembled on a PCB of a communication connector.

The insulative housing 60, the inductive coils 61 and the soldering tails 62 are assembled together to form a modular transformer 6, which is tested independently. Referring to FIG. 3, the transformer is assembled to the communication connector at another manufacture process. During assembly, the transformer 6 is tested, and then is soldered to the PCB 3 of the communication connector. Thus, terminals 4 and solder pins 5 of the communication connector transmit signals stably.

Figure 4:
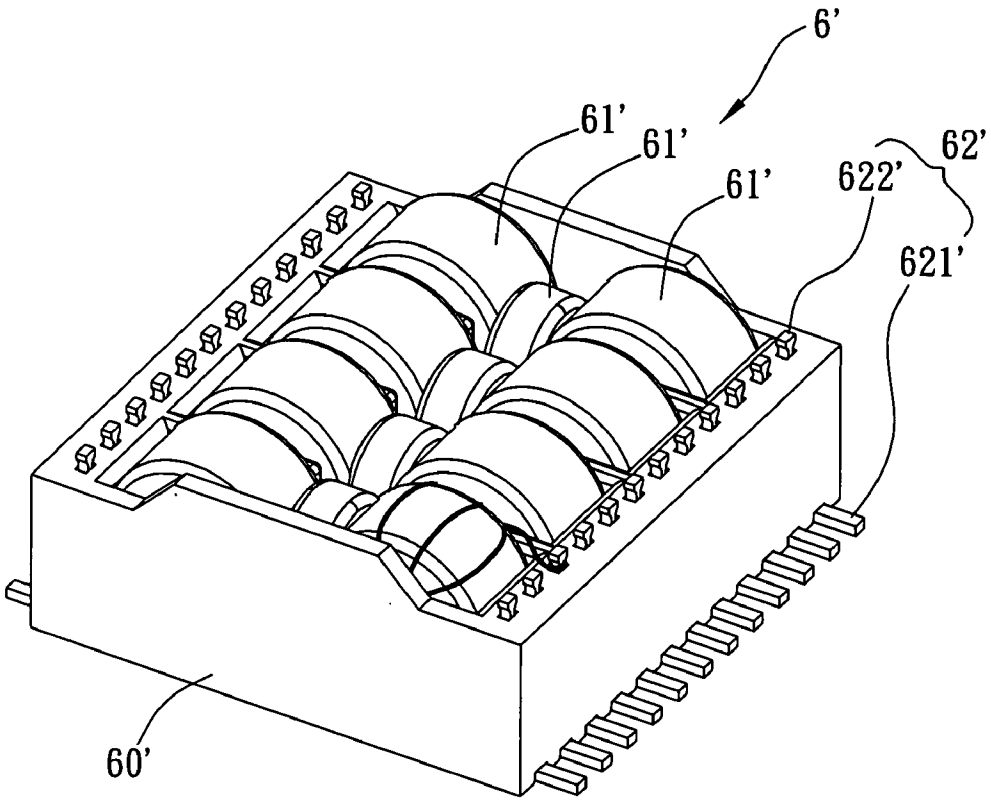
FIG. 4 is a perspective view according to another embodiment of the present invention.

Further referring to FIG. 4, a transformer 6' of another embodiment of the present invention is similar to the transformer 6 of FIG. 1 except each soldering end 621' of the soldering tails 62' is mounted on opposing sidewalls of the bottom wall of the insulative housing 60' and bended perpendicularly therefrom to be planar with the bottom wall. The inductive coils 61' are arranged in such a way that the inductive coils 61' at middle of the insulation housing 60' are substantially in a line while the inductive coils 61' at two sides are substantially perpendicular to the ones at middle.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A transformer comprising:

a rectangular insulative housing having a bottom wall and four sidewalls, and defining an opening toward a top thereof, a plurality of partitions being formed in the insulative housing;

a plurality of inductive coils received between the partitions of the insulative housing, and each inductive coil having a first wire and a signal wire; and a plurality of soldering tails mounted on opposing side walls of the insulative housing, each soldering tail having a soldering end at exterior of the insulative housing for electrically connecting with a PCB of a communication connector, and a wiring end at interior of the insulative housing for connecting with the first wire and the second wire of the inductive coils.

2. The transformer as claimed in claim 1, wherein the partitions are spaced the same distance from each other for receiving the inductive coils.

3. The transformer as claimed in claim 2, wherein a channel is defined through a middle of the partitions for accommodating more inductive coils.

4. The transformer as claimed in claim 3, wherein the bottom wall of the insulative housing is defined being flat.

5. The transformer as claimed in claim 4, wherein two tables are respectively formed on inner surfaces of the opposing sidewalls of the insulative housing for positioning the soldering tails.

6. The transformer as claimed in claim 5, wherein each soldering end of the soldering tails are mounted on opposing sidewalls of the bottom wall of the insulative housing and bended perpendicularly therefrom to be planar with the bottom wall.

7. The transformer as claimed in claim 5, wherein the soldering tails are mounted on opposing sidewalls of the opening of said insulative housing and bended perpendicularly therefrom to be planar with the opening.

8. A transformer comprising:

a rectangular insulative housing having a bottom wall and four sidewalls, and defining an opening toward a top thereof, a plurality of partitions being formed in the insulative housing;

a plurality of inductive coils received between the partitions of the insulative housing, and arranged in such a way that the inductive coils at middle of the insulation housing are substantially in a line while the inductive coils at two sides are substantially perpendicular to the ones at middle, each inductive coil having a first wire and a signal wire; and a plurality of soldering tails mounted on opposing side walls of the insulative housing, each soldering tail having a soldering end at exterior of the insulative housing for electrically connecting with a PCB of a communication connector, and a wiring end at interior of the insulative housing for connecting with the first wire and the second wire of the inductive coils.

9. The transformer as claimed in claim 8, wherein the partitions are spaced the same distance from each other for receiving the inductive coils.

10. The transformer as claimed in claim 9, wherein a channel is defined through a middle of the partitions for accommodating more inductive coils.

* * * * *